US006768253B1

(12) United States Patent
Iwamoto et al.

(10) Patent No.: US 6,768,253 B1
(45) Date of Patent: Jul. 27, 2004

(54) INNER MAGNETIC SHIELD AND CATHODE-RAY TUBE

(75) Inventors: Hiroshi Iwamoto, Osaka (JP); Shin-ichiro Hatta, Nara (JP); Ryuichi Murai, Osaka (JP); Masaki Kawasaki, Osaka (JP); Shigeo Nakatera, Osaka (JP); Tomohisa Mikami, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 88 days.

(21) Appl. No.: 09/889,840

(22) PCT Filed: Nov. 24, 2000

(86) PCT No.: PCT/JP00/08316

§ 371 (c)(1),
(2), (4) Date: Jul. 23, 2001

(87) PCT Pub. No.: WO01/43161

PCT Pub. Date: Jun. 14, 2001

(30) Foreign Application Priority Data

Dec. 13, 1999 (JP) ..... 11-352938

(51) Int. Cl.[7] ..... H01J 29/02; H01J 29/06
(52) U.S. Cl. ..... 313/479; 313/402; 313/326
(58) Field of Search ..... 313/402, 407, 313/479, 326, 239; 174/35 R

(56) References Cited

U.S. PATENT DOCUMENTS

| | | | | |
|---|---|---|---|---|
| 4,229,675 A | | 10/1980 | Matsuki et al. | 313/402 |
| 4,580,076 A | | 4/1986 | Shimoma et al. | 313/402 |
| 4,778,177 A | | 10/1988 | Taksony | 273/26 R |
| 5,097,174 A | | 3/1992 | D'Amato | 313/402 |
| 5,773,924 A | * | 6/1998 | Nakamura | 313/402 |
| 5,850,275 A | | 12/1998 | Watanabe et al. | 349/152 |

FOREIGN PATENT DOCUMENTS

| | | |
|---|---|---|
| CN | 1137165 | 12/1996 |
| JP | 53-15061 | 2/1978 |
| JP | 2-16509 | 5/1990 |
| JP | 5-159713 | 6/1993 |
| JP | 7-192643 | 7/1995 |
| JP | 8-222142 | 8/1996 |
| JP | 8-287839 | 11/1996 |
| JP | 9-147757 | 6/1997 |
| JP | 11-120930 | 4/1999 |
| JP | 11-283524 | 10/1999 |

OTHER PUBLICATIONS

International Search Report for PCT/JP00/08316, May 6, 2001.

* cited by examiner

*Primary Examiner*—Ashok Patel
(74) *Attorney, Agent, or Firm*—Merchant & Gould P.C.

(57) ABSTRACT

An internal magnetic shield includes a pair of opposing long side walls (1), a pair of opposing short side walls (2), and an opening (3) enclosed by these side walls in the center. The short side walls (2) are provided with notches (4) having a substantially home-plate shape. This configuration can reduce mislanding of an electron beam on the entire screen and easily balance the amount of mislanding due to geomagnetism in the tube-axis direction and in the horizontal direction perpendicular to the tube axis. As a result, a cathode ray tube capable of displaying images without displacement and unevenness of colors can be provided.

4 Claims, 13 Drawing Sheets

INNER MAGNETIC SHIELD AND CATHODE-RAY TUBE

TECHNICAL FIELD

The present invention relates to an internal magnetic shield provided in a cathode ray tube to reduce mislanding of an electron beam due to an external magnetic field such as geomagnetism, and to a cathode ray tube including the same.

BACKGROUND ART

FIG. 11 shows a conventional cathode ray tube used in television receivers, computer displays, or the like. An electron beam 81 released from an electron gun 80 is deflected in vertical and horizontal directions by a deflection yoke 82 to scan the entire screen, so that images are reproduced. In this case, when the cathode ray tube is affected by an external magnetic field such as geomagnetism, the path of the electron beam 81 is distorted. Therefore, the electron beam 81 does not reach the desired position on a phosphor screen 84 formed on a front panel 83, resulting in mislanding. To deal with this problem, the cathode ray tube includes an internal magnetic shield 85 that provides a shield against geomagnetism or the like.

As shown in FIG. 12, the internal magnetic shield generally includes a pair of opposing long side walls 86, a pair of opposing short side walls 87, and an opening 88 formed in the center, or substantially V-shaped notches 89 formed on the short side walls 87 as shown in FIG. 13. Such V-shaped notches 89 are disclosed in JP 53 (1978)-15061 A, JP 7 (1995)-192643 A, JP 5 (1993)-159713A, or the like.

When a cathode ray tube, including the internal magnetic shield without notches on the short side walls 87 or with substantially V-shaped notches, is affected by an external magnetic field such as geomagnetism, the amount of mislanding tends to be larger in the periphery of the screen than in the center thereof. In particular, mislanding occurs significantly at the corners, i.e., edges, of the screen. Thus, the conventional internal magnetic shields cause non-uniform mislanding throughout the screen, so that the improvement of mislanding at the corners of the screen has been necessary, particularly for a cathode ray tube that requires high definition.

It is not preferable that the amount of mislanding varies depending on the direction in which the cathode ray tube is oriented. To avoid this, it is preferable that the amount of mislanding due to geomagnetism in the tube-axis direction is substantially the same as that of mislanding due to geomagnetism in the horizontal direction perpendicular to the tube axis. However, it is difficult to reduce the amount of mislanding throughout the screen while achieving the balance between two mislandings by geomagnetism in different directions.

DISCLOSURE OF INVENTION

Therefore, with the foregoing in mind, it is an object of the present invention to provide an internal magnetic shield that can reduce mislanding of a deflected electron beam by an external magnetic field such as geomagnetism and prevent the displacement and unevenness of colors on the entire screen. It is another object of the present invention to provide an internal magnetic shield that easily can balance the amount of mislanding due to geomagnetism in the tube-axis direction and in the horizontal direction perpendicular to the tube axis while reducing mislanding throughout the screen. It is yet another object of the present invention to provide a cathode ray tube that can display favorable images with reduced displacement and unevenness of colors on the entire screen by including the above internal magnetic shield.

To achieve the above objects, a first internal magnetic shield for a cathode ray tube of the present invention includes a pair of opposing long side walls, a pair of opposing short side walls, and an opening enclosed by these side walls in the center. At least one pair of the long and short side walls are provided with notches having a substantially home-plate shape.

A second internal magnetic shield for a cathode ray tube of the present invention includes a pair of opposing long side walls, a pair of opposing short side walls, and an opening enclosed by these side walls in the center. At least one pair of the long and short side walls are provided with notches. Each of the notches is formed by at least two pairs of opposing cutting edges with different orientations.

The above first and second internal magnetic shields can reduce mislanding of a deflected electron beam by an external magnetic field such as geomagnetism and prevent the displacement and unevenness of colors on the entire screen. Moreover, they easily can balance the amount of mislanding due to geomagnetism in the tube-axis direction and in the horizontal direction perpendicular to the tube axis while reducing mislanding throughout the screen.

A cathode ray tube of the present invention includes an envelope having a front panel and an funnel, a phosphor screen formed on the inner surface of the front panel, a color selection electrode arranged to face the phosphor screen, an electron gun placed in the funnel, and an internal magnetic shield placed between the color selection electrode and the electron gun. The internal magnetic shield is the magnetic shield according to the above first or second internal magnetic shield.

The above cathode ray tube can display favorable images with reduced displacement and unevenness of colors on the entire screen, regardless of the direction in which the cathode ray tube is oriented.

BEST MODE FOR CARRYING OUT THE INVENTION

Hereinafter, the present invention will be described with reference to FIGS. 1 to 10.

Embodiment 1

Figure 1:
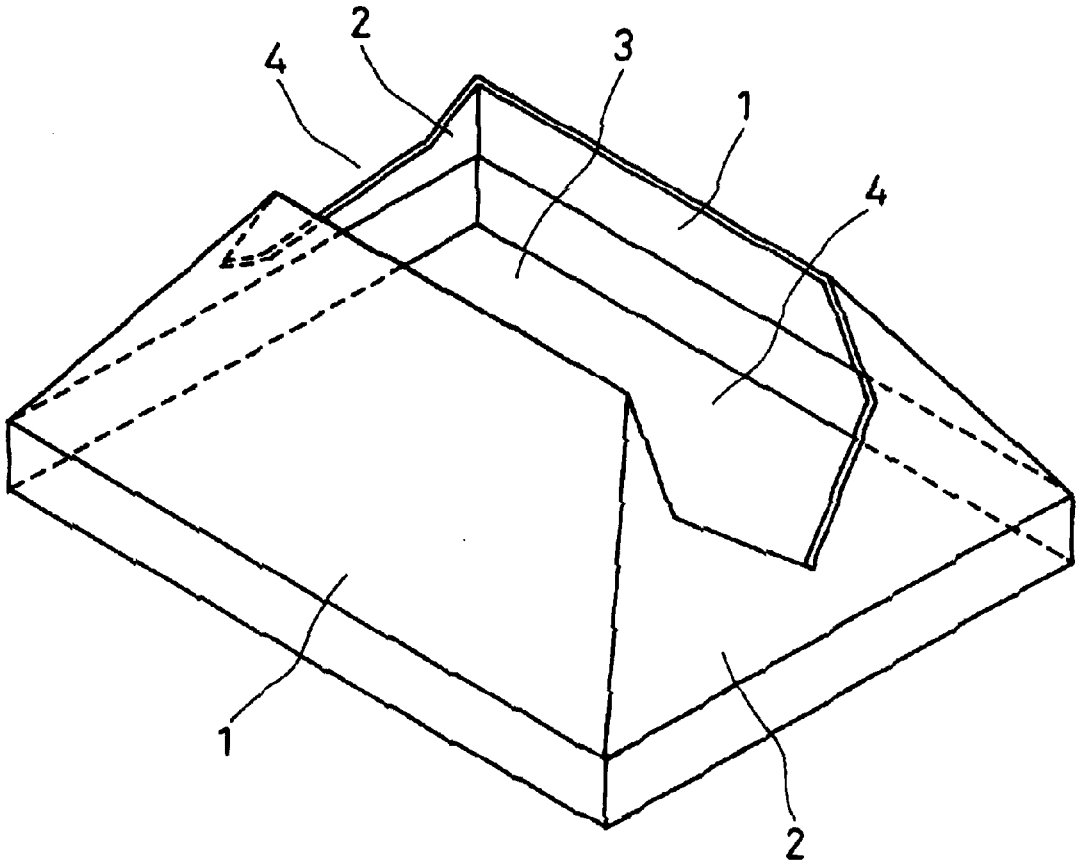
FIG. 1 is a schematic perspective view of an internal magnetic shield according to Embodiment 1 of the present invention.

FIG. 1 is a perspective view of an internal magnetic shield according to Embodiment 1 of the present invention.

The internal magnetic shield of this embodiment has a pair of opposing long side walls 1 substantially in the form of a trapezoid and a pair of opposing short side walls 2 substantially in the form of a trapezoid. These side walls are joined to form a part of the surface of a quadrilateral pyramid. An opening 3 enclosed by the long and short side walls 1,2 is formed in the center of the shield. The internal magnetic shield is placed in a cathode ray tube with the small-width side (the upper side of FIG. 1) facing an electron gun and the large-width side (the lower side of FIG. 1) facing a phosphor screen. An electron beam passes through the opening 3. The short side walls are provided with notches 4, each being formed from the ends of the short side walls 2 on the electron gun side to the phosphor screen side.

Figure 2:
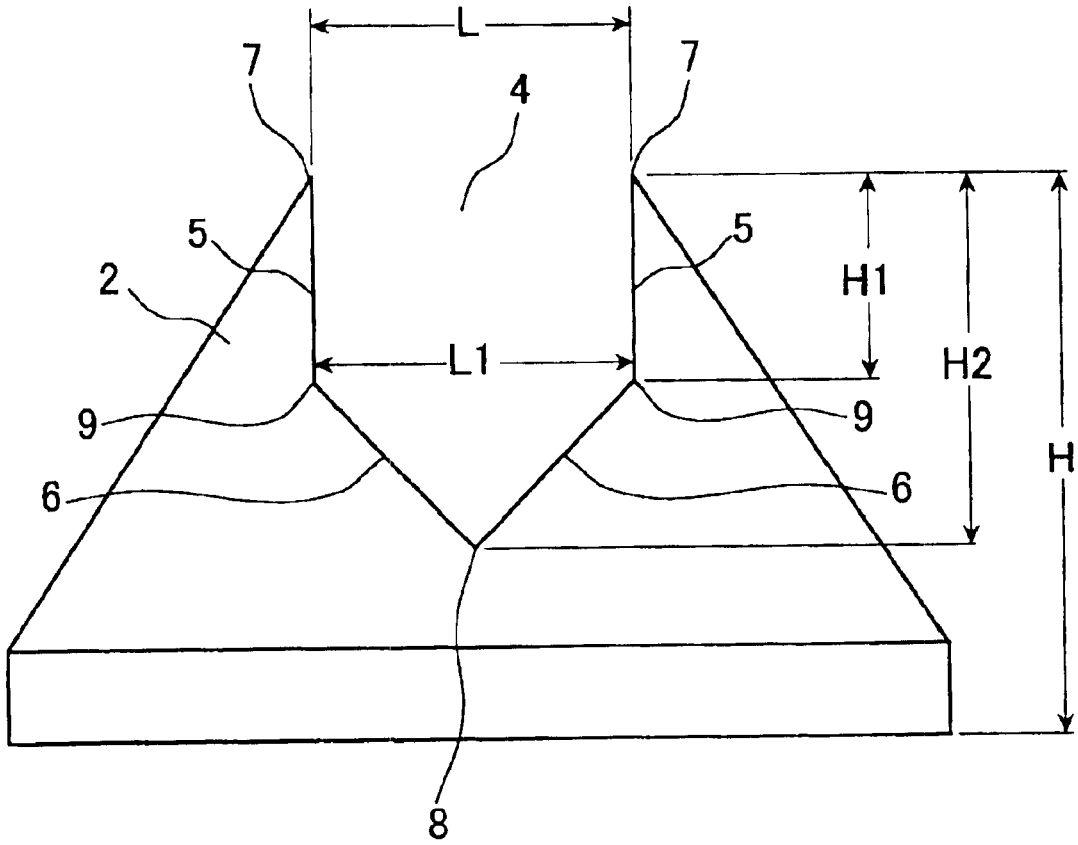
FIG. 2 is a side view of an internal magnetic shield according to Embodiment 1 of the present invention when viewed from the side of a short side wall.

FIG. 2 is a side view of the internal magnetic shield in FIG. 1 when viewed from the side of the short side wall 2. The vertical direction of FIG. 2 corresponds to the direction of the tube axis of a cathode ray tube that includes the internal magnetic shield.

In FIG. 2, the notch 4 has a bilateral symmetry formed of a pair of opposing first cutting edges 5 and a pair of opposing second cutting edges 6. The first cutting edges 5 are parallel to each other. In the side view of FIG. 2, which is a projection of the internal magnetic shield in the direction parallel to the long side of the rectangular phosphor screen when the shield is installed in the cathode ray tube, each of the first cutting edges 5 is parallel to the tube axis as well. The second cutting edges 6 intersect to form a V shape, so that a bottom 8 of the notch 4 is provided. The ends of the second cutting edges 6 opposite to the bottom 8 are connected to the first cutting edges 5. Since the first and second cutting edges 5, 6 are formed in different directions, each of the connections between them has a bend 9. As described above, the notch 4 has a substantially home-plate shape. The notch 4 thus formed is provided symmetrically on each of two opposing short side walls 2.

Here, as shown in FIG. 2, an opening width of the notch 4 on the electron gun side (i.e., the distance between the ends 7 of the opening) is defined as L; a notch width of the parallel notch portion having a constant notch width (i.e., the portion of the first cutting edges 5) is defined as L1 (in this embodiment, L1=L); a height of the internal magnetic shield (the length in the tube-axis direction) is defined as H; a depth of the parallel notch portion (the length in the tube-axis direction) is defined as H1; and a depth of the notch 4 (the length in the tube-axis direction) is defined as H2.

Figure 3:
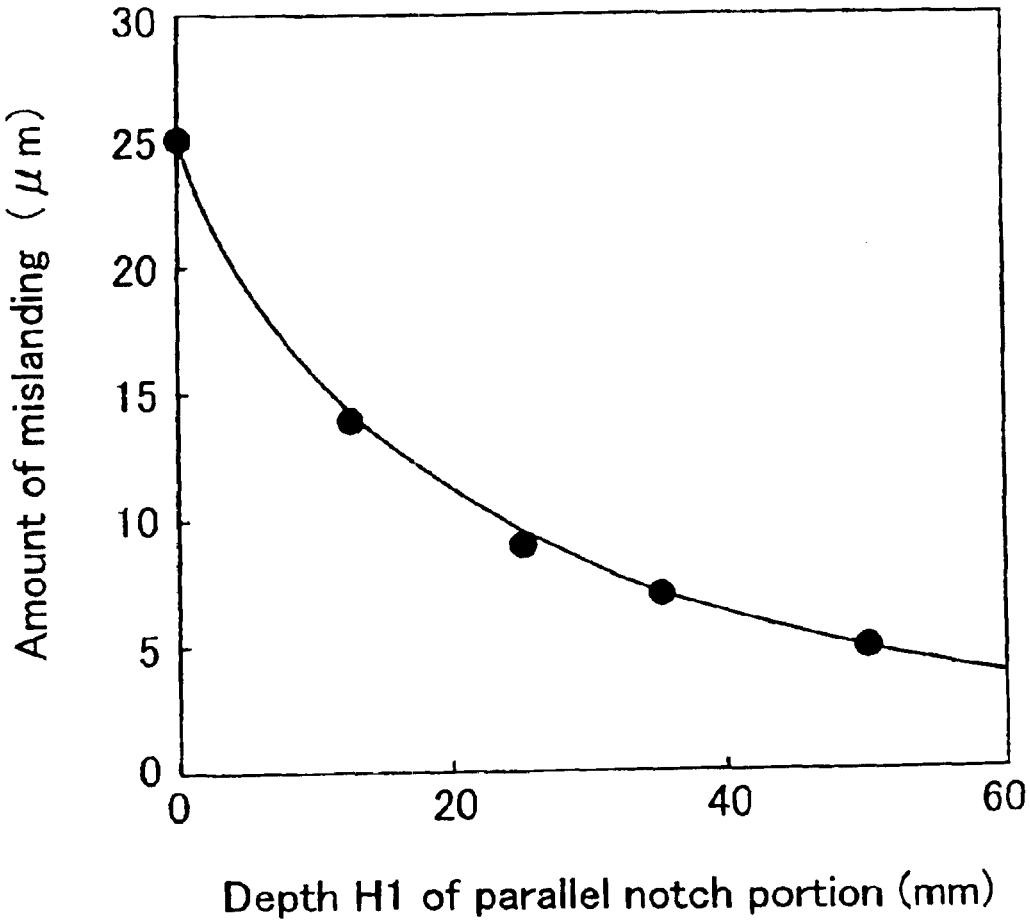
FIG. 3 shows the relationship between the depth of a parallel notch portion and the amount of mislanding due to geomagnetism in the tube-axis direction of an internal magnetic shield according to Embodiment 1 of the present invention.

FIG. 3 shows the amount of mislanding at the corners of the screen due to geomagnetism in the tube-axis direction (hereinafter, referred to as "tube-axis geomagnetism"), when the internal magnetic shield for a cathode ray tube having a 25-inch diagonal size is used so that the notch width L1 and the depth H2 of the notch 4 are fixed, while the depth H1 of the parallel notch portion is changed. When H1=0, the notch 4 has a V shape.

As can be seen from the FIG. 3, the amount of mislanding at the corners of the screen due to the tube-axis magnetic field is decreased with increasing the depth H1 of the parallel notch portion of the notch 4. The reason for this is as follows: the tube-axis geomagnetism is drawn to the ends 7 of the opening and the first cutting edges 5, so that the magnetic field thus drawn cancels the force to be exerted by an external magnetic field such as geomagnetism on the electron beam traveling through its path to the phosphor screen within the internal magnetic shield. However, when H1=H2, the shield effect against geomagnetism in the horizontal direction perpendicular to the tube axis (hereinafter, referred to as "horizontal geomagnetism") is reduced, causing an increase in the amount of mislanding due to the horizontal geomagnetism.

Figure 4:
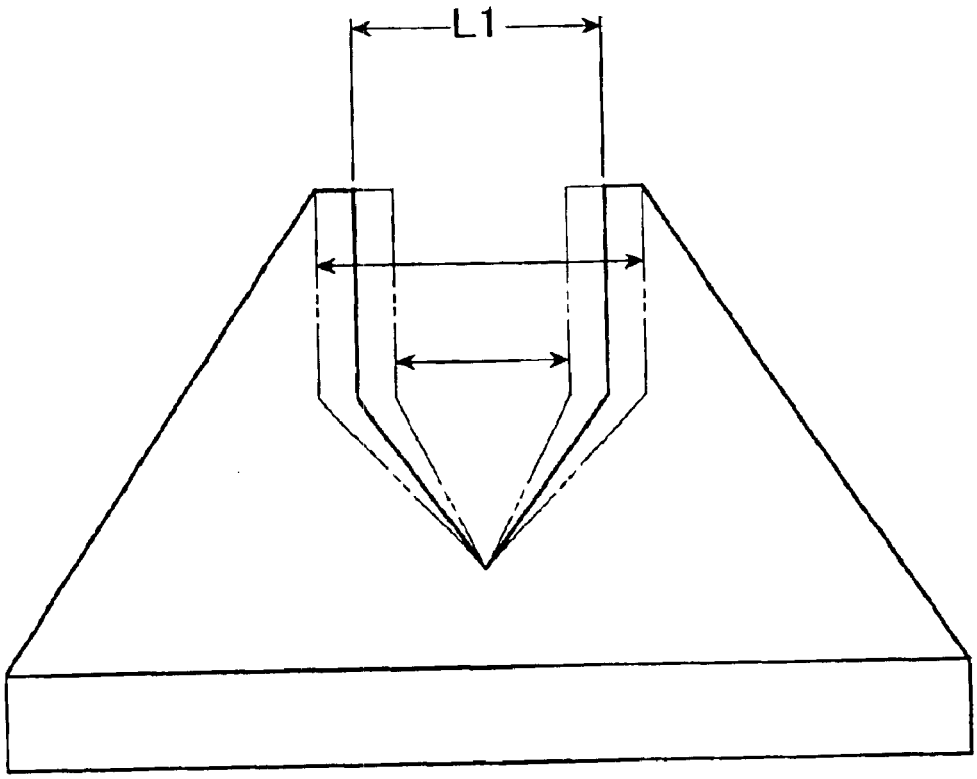
FIG. 4 is a side view of an internal magnetic shield according to Embodiment 1 of the present invention when viewed from the side of a short side wall, in which the width of a notch is changed.
Figure 5:
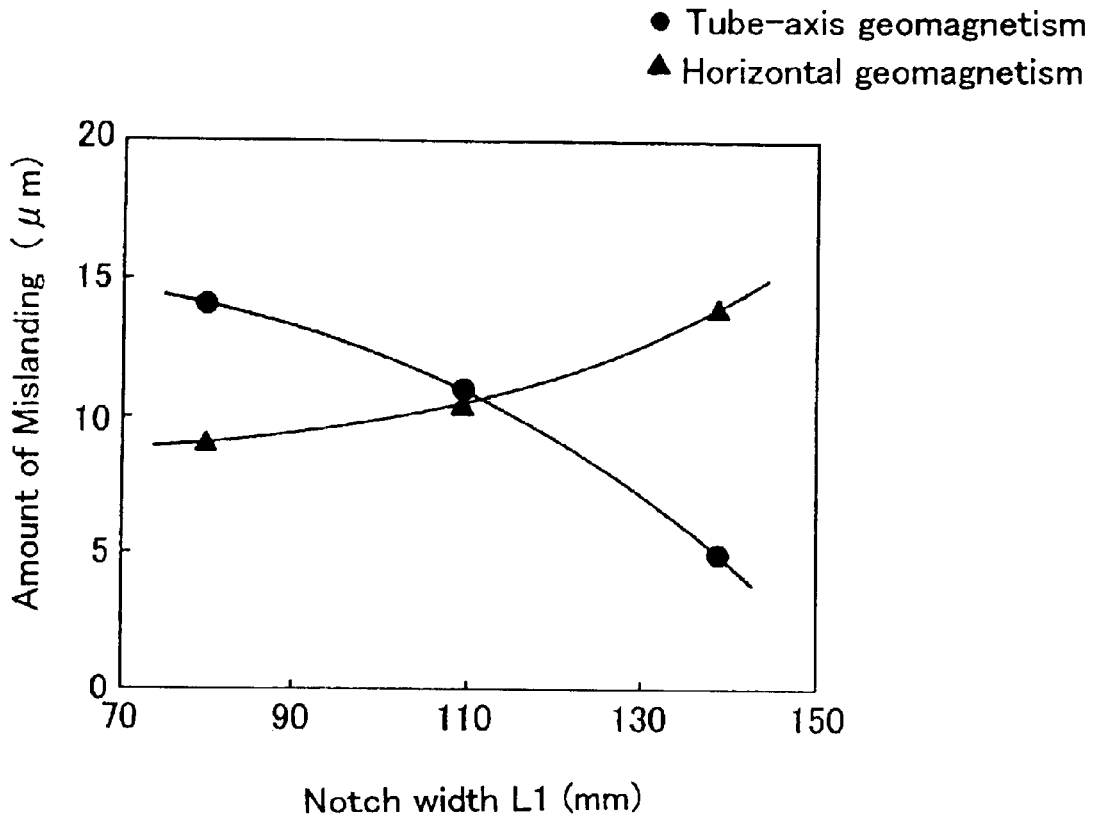
FIG. 5 shows the relationship between the width of a notch and the amount of mislanding of an internal magnetic shield according to Embodiment 1 of the present invention.

Depending on the type of tube, the notch width L1 may be changed as shown in FIG. 4 to achieve the balance in the amount of mislanding due to the tube-axis geomagnetism and the horizontal geomagnetism. FIG. 5 shows the amount of mislanding at the corners of the screen due to the tube-axis geomagnetism and that due to the horizontal geomagnetism, when the depth H1 of the parallel notch portion and the depth H2 of the notch 4 are fixed, while the notch width L1 is changed. Since the shield effect against the horizontal magnetic field is increased with the decrease in the notch width L1, the amount of mislanding due to the horizontal geomagnetism is reduced, while the amount of mislanding due to the tube-axis geomagnetism is increased. Moreover, two curves, representing the amount of mislanding due to the tube-axis geomagnetism and that due to the horizontal geomagnetism, intersect with each other. This indicates that the balance in the amount of mislanding due to the tube-axis geomagnetism and the horizontal geomagnetism can be achieved.

Figure 6:
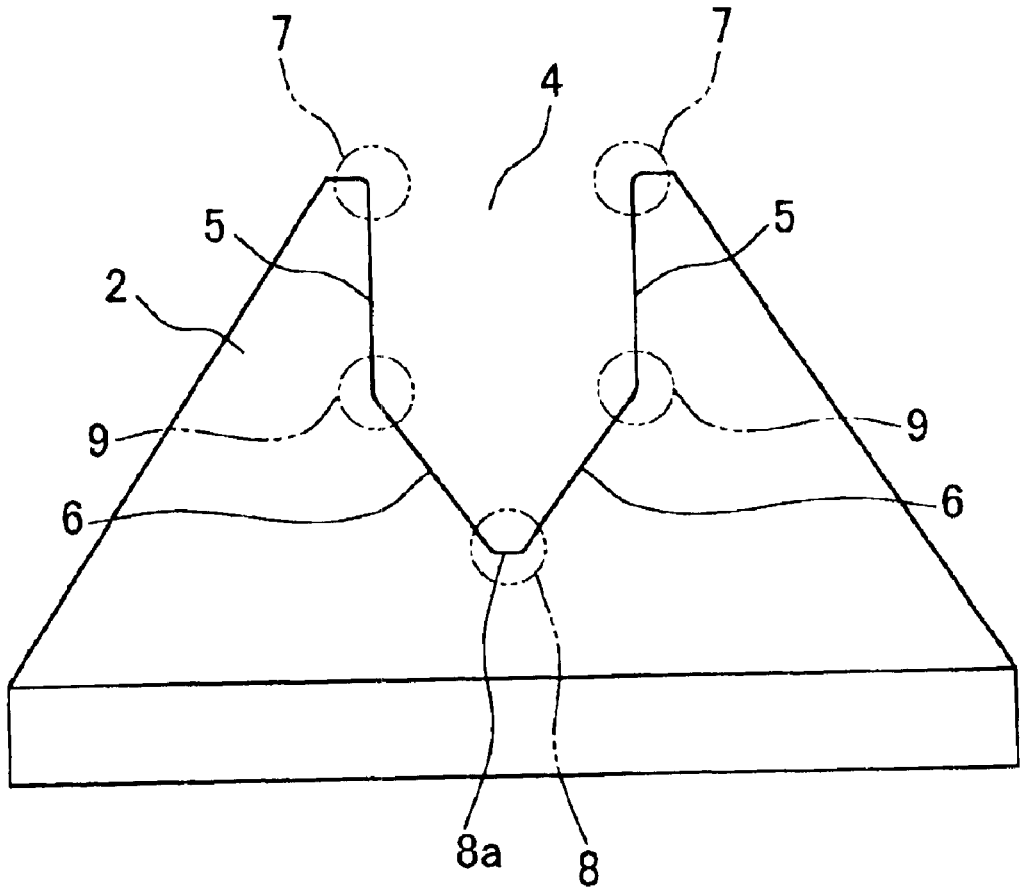
FIG. 6 is a side view of an internal magnetic shield having another configuration of Embodiment 1 of the present invention when viewed from the side of a short side wall.

The bottom 8 of the notch 4 may be formed in the following manner instead of simply intersecting a pair of second cutting edges 6: as shown in FIG. 6, the second cutting edges 6 are connected via a straight cutting edge 8*a* substantially parallel to the phosphor screen or a circular arc portion (with a rounded corner). Also, the ends 7 of the opening and the bends 9 may be formed to have a circular arc shape (with a rounded corner).

Using the above internal magnetic shield can form a diamagnetic field that cancels the force to be exerted by an external magnetic field such as geomagnetism on the electron beam traveling through its path to the phosphor screen. As a result, the force exerted on the electron beam is reduced, which leads to a reduction in mislanding caused by the distortion of the electron beam path. Thus, the displacement and unevenness of colors can be prevented on the entire screen. Moreover, this embodiment easily can balance the amount of mislanding due to the tube-axis geomagnetism and the horizontal geomagnetism perpendicular to the tube axis while reducing mislanding throughout the screen.

Embodiment 2

Figure 7:
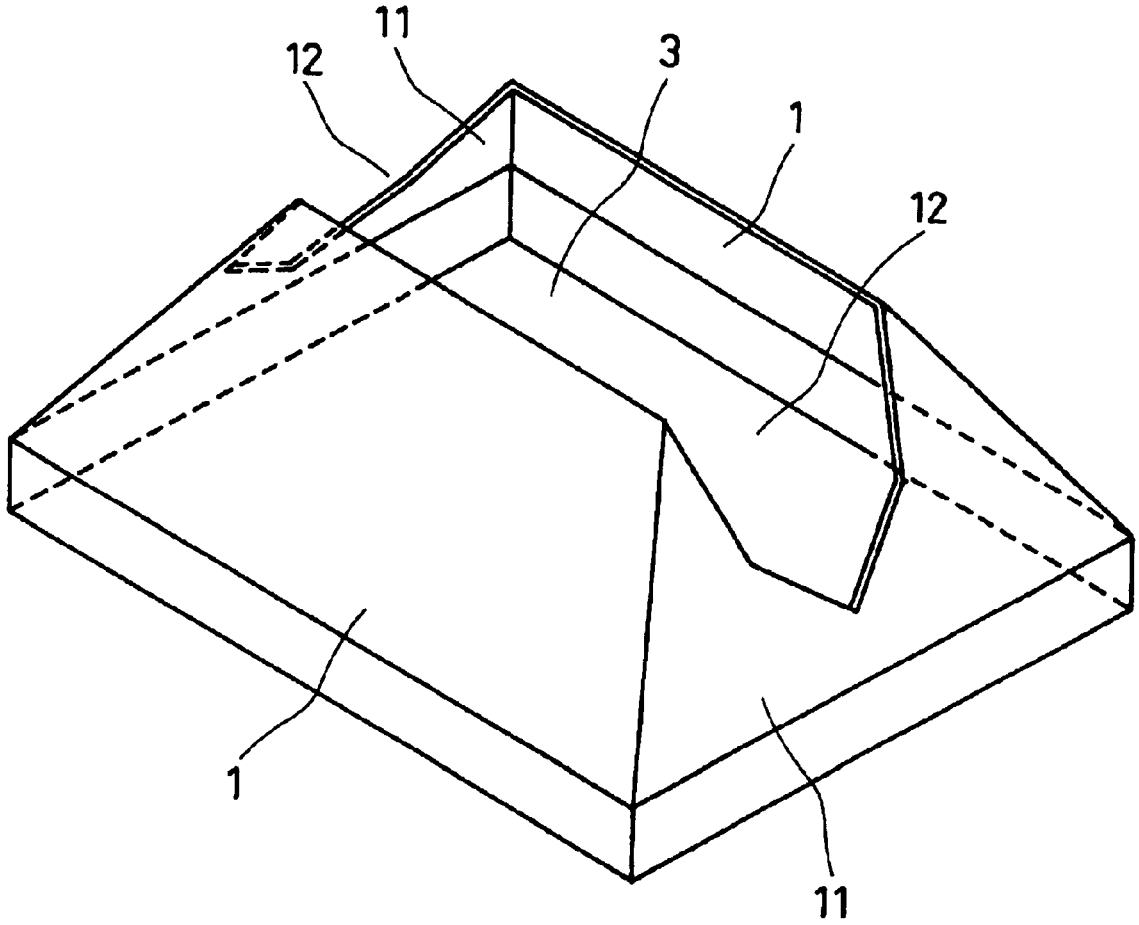
FIG. 7 is a schematic perspective view of an internal magnetic shield according to Embodiment 2 of the present invention.

FIG. 7 is a perspective view showing an internal magnetic shield of Embodiment 2 of the present invention.

The internal magnetic shield of this embodiment has a pair of opposing long side walls 1 substantially in the form of a trapezoid and a pair of opposing short side walls 11 substantially in the form of a trapezoid. These side walls are joined to form a part of the surface of a quadrilateral pyramid. An opening 3 enclosed by the long and short side walls 1, 11 is formed in the center of the shield. The short side walls 11 are provided with notches 12, each being formed from the ends of the short side walls 11 on the electron gun side to the phosphor screen side.

The notches 12 on the short side walls 11 of Embodiment 2 have a shape different from that of the notches 4 of Embodiment 1.

Figure 8:
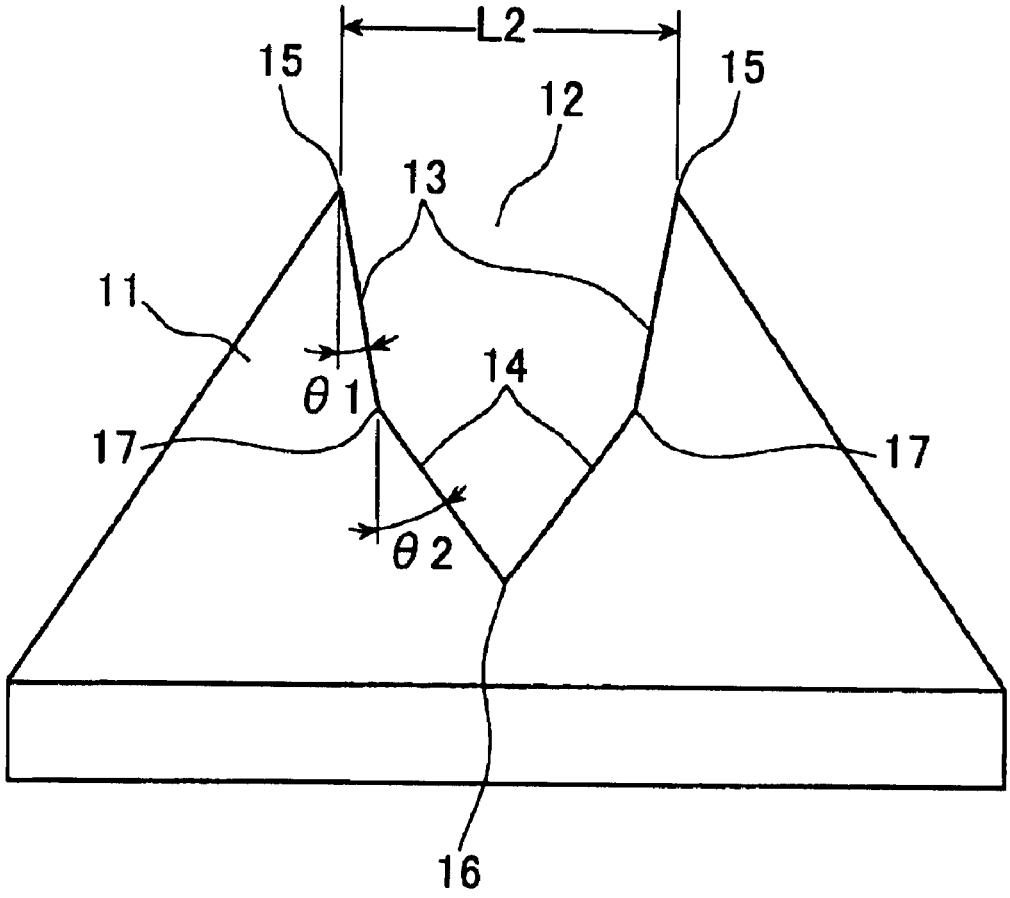
FIG. 8 is a side view of an internal magnetic shield according to Embodiment 2 of the present invention when viewed from the side of a short side wall.

FIG. 8 is a side view of the internal magnetic shield in FIG. 7 when viewed from the side of the short side wall 11. The vertical direction of FIG. 8 corresponds to the direction of the tube axis of a cathode ray tube that includes the internal magnetic shield.

In FIG. 8, the notch 12 has a bilateral symmetry formed of a pair of opposing first cutting edges 13 and a pair of opposing second cutting edges 14. In the side view of FIG. 8, which is a projection of the internal magnetic shield in the direction parallel to the long side of the rectangular phosphor screen when the shield is installed in the cathode ray tube, each of the first cutting edges 13 is inclined at an angle of θ1 with respect to the tube axis, and each of the second cutting edges 14 is inclined at an angle of θ2 with respect to the tube axis. The second cutting edges 14 intersect to form a V shape, so that a bottom 16 of the notch 12 is provided. The ends of the second cutting edges 14 opposite to the bottom 16 are connected to the first cutting edges 13. Since the first and second cutting edges 13, 14 are formed in different directions, each of the connections between them has a bend 17. The notch 12 thus formed is provided symmetrically on each of two opposing short side walls 11.

As described above, the notch 12 is formed by two pairs of opposing cutting edges 13, 14 with different orientations. Therefore, like Embodiment 1, the tube-axis geomagnetism is drawn to the ends 15 of the opening and the first cutting edges 13, so that the magnetic field thus drawn cancels the force to be exerted by an external magnetic field such as geomagnetism on the electron beam traveling through its path to the phosphor screen within the internal magnetic shield. As a result, the amount of mislanding is reduced. However, when an inclination angle of θ2 is equal to that of θ1, the shield effect against the horizontal geomagnetism is reduced, causing an increase in the amount of mislanding due to the horizontal geomagnetism.

Figure 9:
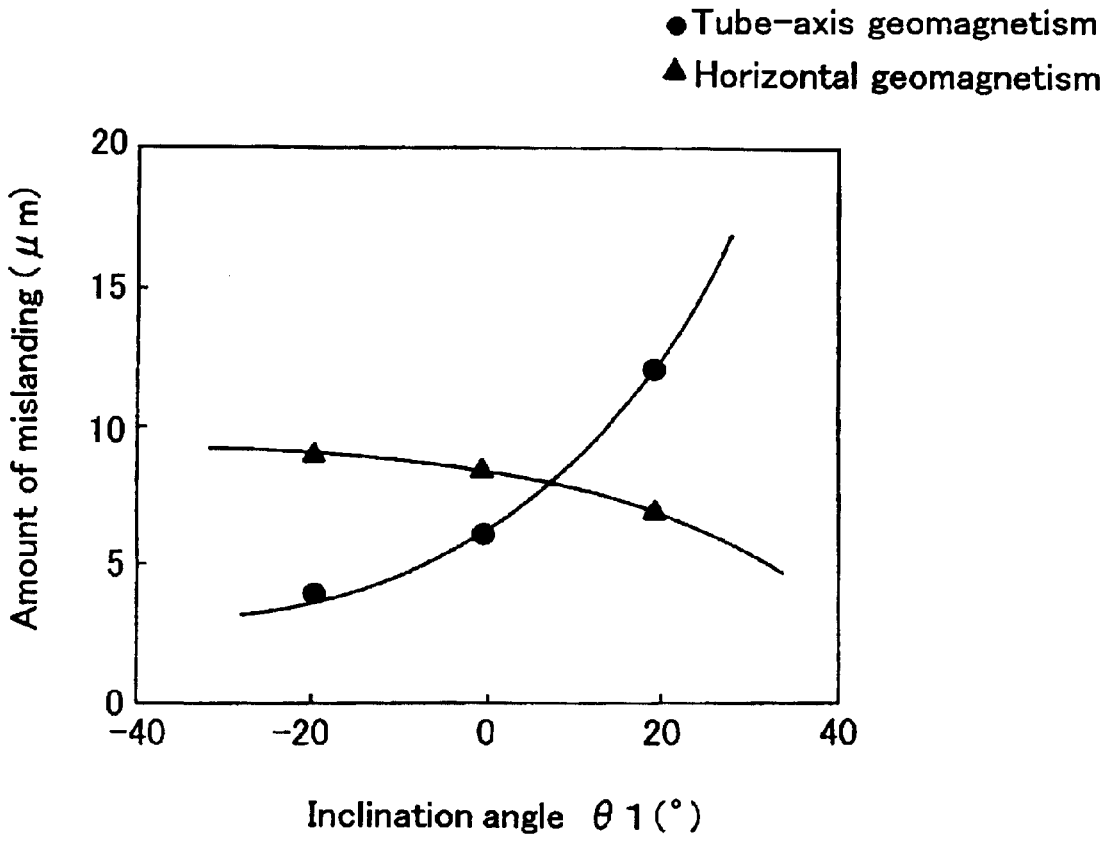
FIG. 9 shows the relationship between an inclination angle 61 and the amount of mislanding of an internal magnetic shield according to Embodiment 2 of the present invention.

FIG. 9 shows the amount of mislanding due to the tube-axis geomagnetism and that due to the horizontal geomagnetism, when the internal magnetic shield for a cathode ray tube having a 25-inch diagonal size is used so that the length of each of the first cutting edges 13 in the tube-axis direction is fixed, while the inclination angle θ1 is changed. Here, the angle θ1 is defined to have a positive sign when a pair of first cutting edges 13 are inclined in such a direction that the distance between the bends 17 is smaller than that between the ends 15 of the opening, as shown in FIG. 8. As shown in FIG. 9, two curves, representing the amount of mislanding due to the tube-axis geomagnetism and that due to the horizontal geomagnetism, intersect with each other. This indicates that the balance in the amount of mislanding due to the tube-axis geomagnetism and the horizontal geomagnetism can be achieved. When the inclination angle θ1 of the first cutting edges 13 is reduced to 0° or less, the amount of mislanding due to the tube-axis geomagnetism can be reduced without changing the amount of mislanding due to the horizontal geomagnetism significantly.

Like Embodiment 1, the bottom 16 of the notch 12 may be formed in the following manner instead of simply intersecting a pair of second cutting edges 14: the second cutting edges 14 are connected via a straight cutting edge substantially parallel to the phosphor screen or a circular arc portion (with a rounded corner). Also, the ends 15 of the opening and the bends 17 may be formed to have a circular arc shape (with a rounded corner). Moreover, depending on the type of tube, the opening width L2 of the notch 12 on the electron gun side (i.e., the distance between the ends 15 of the opening) may be changed.

In the above explanation, the notch is formed by two pairs of opposing cutting edges 13, 14 with different orientations. However, it should be noted that the notch may be formed by three or more pairs of cutting edges with different orientations to achieve the balance of mislanding.

Using the above internal magnetic shield can form a diamagnetic field that cancels the force to be exerted by an external magnetic field such as geomagnetism on the electron beam traveling through its path to the phosphor screen. As a result, the force exerted on the electron beam is reduced, which leads to a reduction in mislanding caused by the distortion of the electron beam path. Thus, the displacement and unevenness of colors can be prevented on the entire screen. Moreover, this embodiment easily can balance the amount of mislanding due to the tube-axis geomagnetism and the horizontal geomagnetism perpendicular to the tube axis while reducing mislanding throughout the screen.

Embodiment 3

Figure 10:
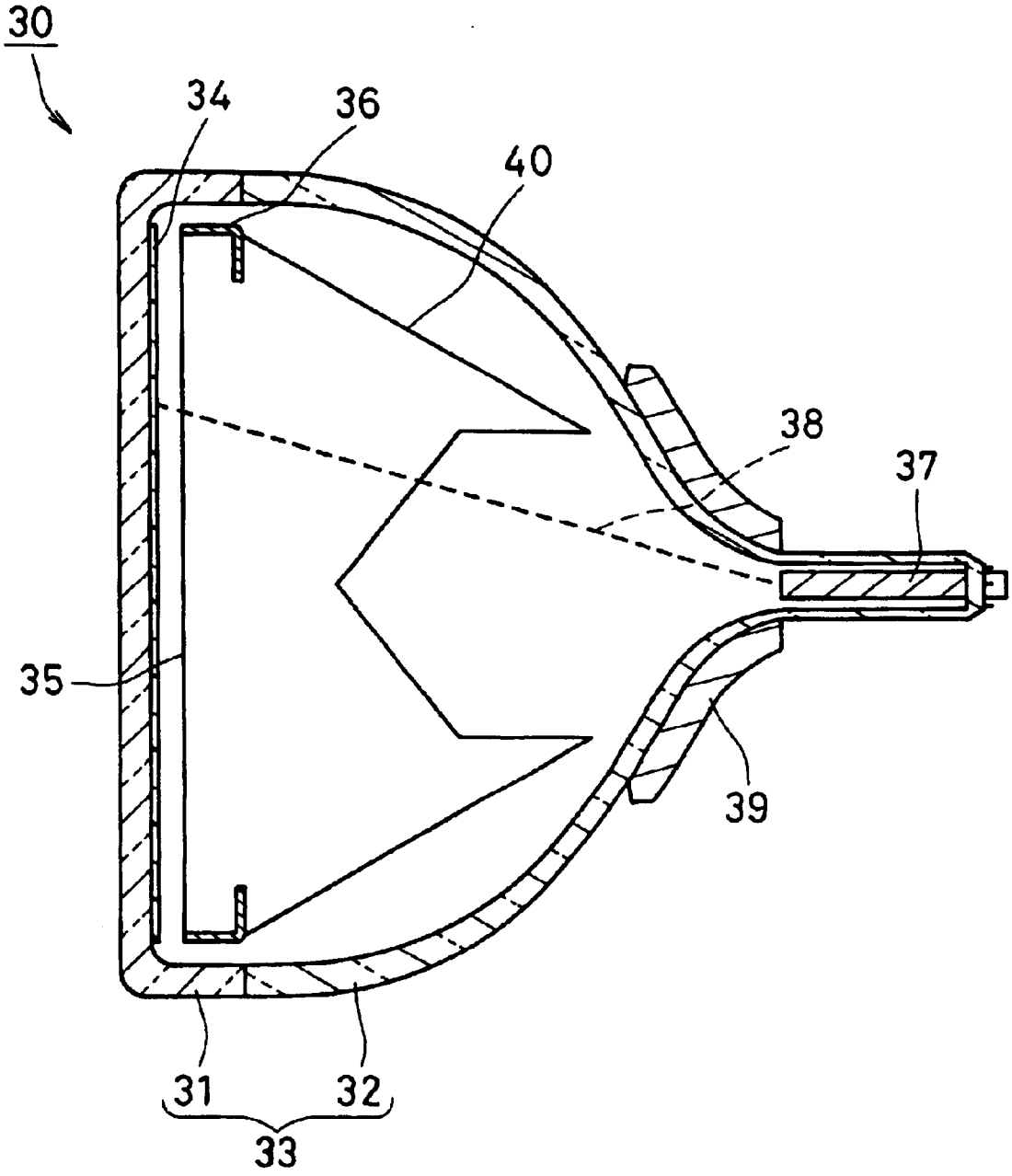
FIG. 10 is a cross-sectional view showing the schematic configuration of a color cathode ray tube of the present invention.
Figure 11:
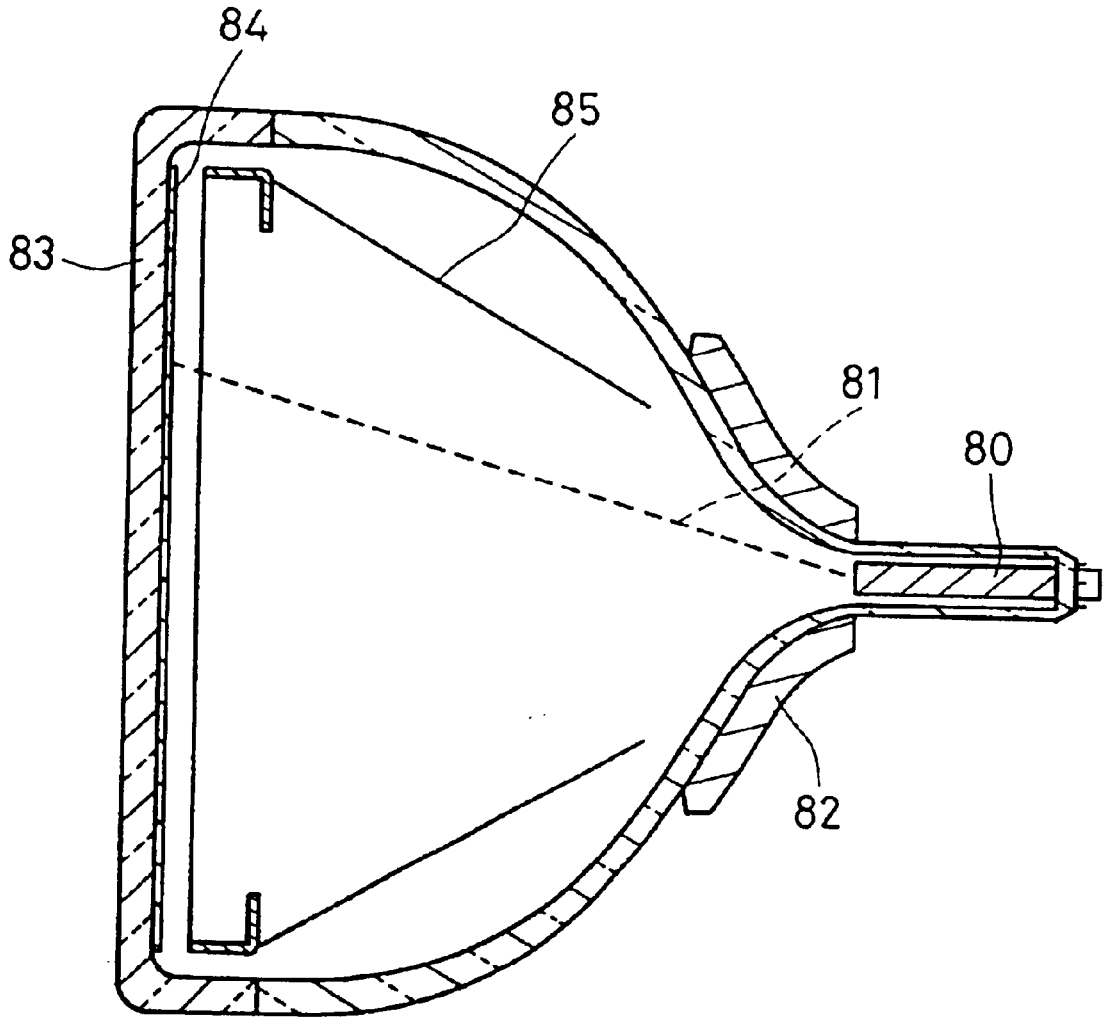
FIG. 11 (PRIOR ART)
FIG. 11 is a schematic cross-sectional view of a conventional cathode ray tube.
Figure 12:
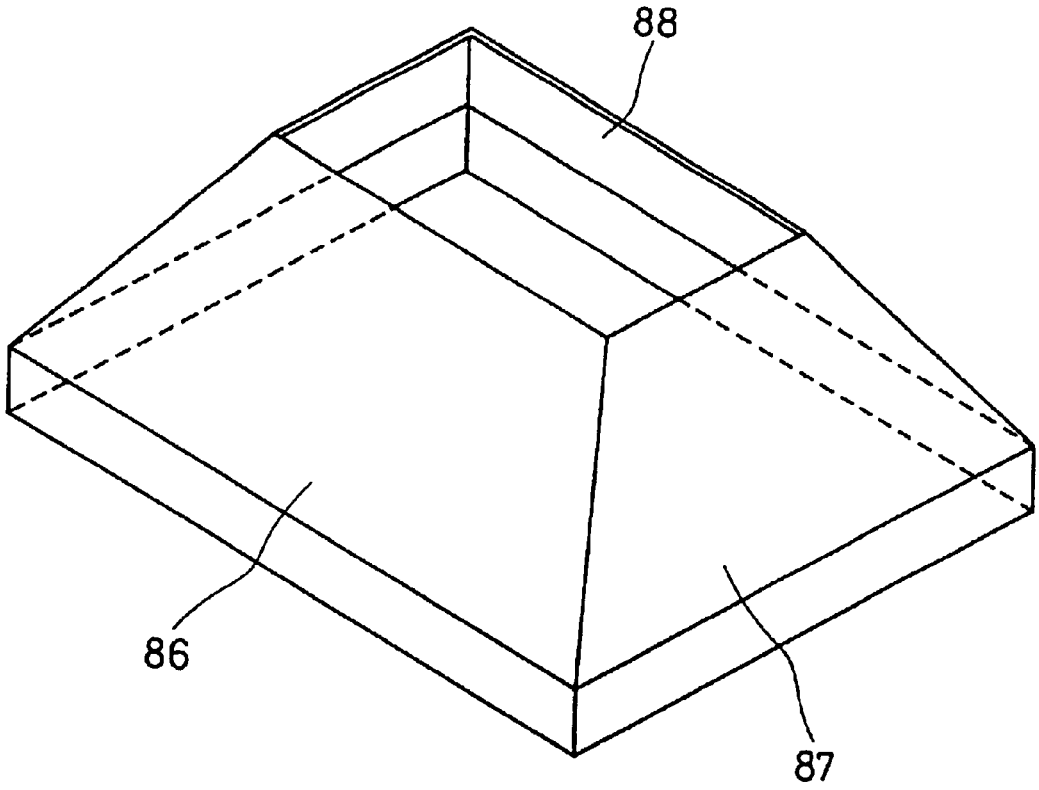
FIG. 12 (PRIOR ART)
FIG. 12 is a schematic perspective view of a conventional internal magnetic shield.
Figure 13:
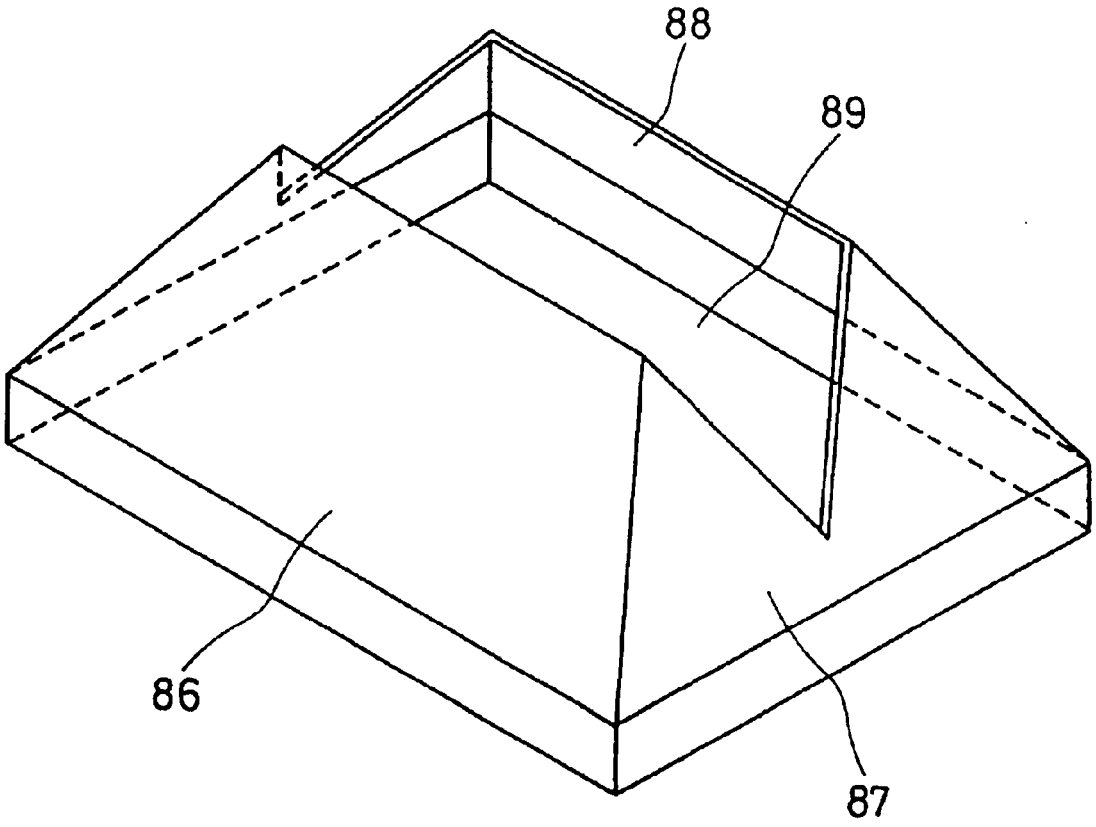
FIG. 13 (PRIOR ART)
FIG. 13 is a schematic perspective view of another conventional internal magnetic shield.

FIG. 10 is a cross-sectional view of a color cathode ray tube 30 of the present invention taken along the tube axis in the vertical direction.

A front panel 31 and a funnel 32 are joined to form an envelope 33. A substantially rectangular phosphor screen 34 is formed on the inner surface of the front panel 31. A color selection electrode (e.g., a shadow mask) 35 is stretched by a frame 36 so as to be spaced away from the phosphor screen 34 and opposed thereto. The frame 36 is held with the front panel 31 by engaging an elastic supporting body (not shown) in the form of a plate spring with a panel pin (not shown), the elastic supporting body being provided on the circumferential surface of the frame 36 and the panel pin being planted on the inner surface of the front panel 31. An electron gun 37 is contained in a neck portion of the funnel 32. An internal magnetic shield 40 is mounted on the frame 36 on the electron gun 37 side of the frame 36. A deflection yoke 39 that deflects an electron beam 38 from the electron gun 37 for scanning is provided on the circumferential surface of the funnel 32.

In the above color cathode ray tube 30 of the present invention, the internal magnetic shield of Embodiment 1 or 2 is used as the internal magnetic shield 40.

As described above, the internal magnetic shield 40 can form a diamagnetic field that cancels the force to be exerted by an external magnetic field such as geomagnetism on the electron beam 38 traveling through its path to the phosphor screen 34. As a result, the force exerted on the electron beam 38 is reduced, which leads to a reduction in mislanding caused by the distortion of the electron beam path. Thus, images without the displacement and unevenness of colors on the entire screen can be displayed. Moreover, this embodiment easily can balance the amount of mislanding due to the tube-axis geomagnetism and the horizontal geomagnetism perpendicular to the tube axis while reducing mislanding throughout the screen. Therefore, even if the direction in which the cathode ray tube is oriented is changed, images with reduced displacement and unevenness of colors always can be displayed.

In the internal magnetic shields of Embodiments 1 to 3, the short side walls have the notches. However, the present invention is not limited thereto. Depending on the purpose of the use of a cathode ray tube or the like, the same notches as those in the above embodiments may be formed on the long side walls instead of the short side walls, or they may be formed on both long and short side walls.

In the internal magnetic shield of Embodiments 1 to 3, the notches are formed by straight cutting edges. However, the present invention is not limited thereto. As long as the objects of the present invention can be achieved, the whole portion of each cutting edge or a part of it (e.g., the end of the cutting edge) may be curved slightly.

There is no particular limitation on the material of an internal magnetic shield of the present invention, and a material with high permeability, e.g., iron or the like, can be used like a conventional internal magnetic shield. Also, the internal magnetic shield of the present invention can be manufactured in the same manner as that for the conventional one, such as by pressing.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An internal magnetic shield for a cathode ray tube comprising:

A pair of opposing long side walls;

a pair of opposing short side walls; and an opening enclosed by these side walls in a center, wherein at least one pair of the long and short side walls are provided with notches having a substantially home-plate shape.

2. The internal magnetic shield according to claim 1, wherein a straight cutting edge substantially parallel to a phosphor screen is formed at a bottom of each of the notches.

3. A cathode ray tube comprising:

an envelope having a front panel and a funnel;

a phosphor screen formed on an inner surface of the front panel;

a color selection electrode arranged to face the phosphor screen;

an electron gun placed in the funnel; and an internal magnetic shield placed between the color selection electrode and the electron gun, wherein said internal magnetic shield is the magnetic shield according to claim 1.

4. An internal magnetic shield for a cathode ray tube comprising:

a pair of opposing long side walls;

a pair of opposing sort side walls; and an opening enclosed by these side walls in a center, wherein at least one pair of the long and short side walls are provided with one notch on each respective wall, and each of the notches is formed by at least two pairs of opposing cutting edges with different orientations, and one pair of the at least two pairs of opposing cutting edges are provided so that a width of the opposing cutting edges is increased from an electron gun side to a phosphor screen side.

* * * * *